US005666938A

United States Patent [19]

Simonds

[11] Patent Number: 5,666,938

[45] Date of Patent: Sep. 16, 1997

[54] BOW STRING KISSER BUTTON

[75] Inventor: Gary L. Simonds, Gainesville, Fla.

[73] Assignee: Bear Archery, Inc., Gainesville, Fla.

[21] Appl. No.: 509,224

[22] Filed: Jul. 31, 1995

[51] Int. Cl.[6] ..... F41B 5/14

[52] U.S. Cl. ..... 124/90

[58] Field of Search ..... 124/87, 90, 91, 124/92; 33/265; D22/107

[56] References Cited

U.S. PATENT DOCUMENTS

| | | | |
|---|---|---|---|
| 3,059,629 | 10/1962 | Stinson | 124/92 X |
| 3,584,615 | 6/1971 | Stinson | 124/92 |
| 4,539,970 | 9/1985 | Griz | 124/90 |
| 5,056,498 | 10/1991 | Scherz | 124/87 |
| 5,080,084 | 1/1992 | Kendall et al. | 124/87 |

FOREIGN PATENT DOCUMENTS

| | | | |
|---|---|---|---|
| 709633 | 5/1965 | Canada | 124/87 |

*Primary Examiner*—John A. Ricci
*Attorney, Agent, or Firm*—Malina & Wolson

[57] ABSTRACT

An improved bow string kisser button having at least two radial slots therein and a hub portion extending from the center of the kisser button.The strands of the bow string are inserted in the kisser button slots and the kisser button is secured to the bowstring at the desired location.

18 Claims, 1 Drawing Sheet

BOW STRING KISSER BUTTON

BACKGROUND OF THE INVENTION

1. Field of the Invention

The present invention relates to an improved bow string kisser button for an archery bow which assists the archer in drawing the bow string to the same point for each shot.

2. Description of the Prior Art

Kisser button means have been provided for assisting the archer to draw the bow string to the same point each time the bow is shot. An example of such a kisser button is disclosed in U.S. Pat. No. 4,539,970. The kisser button disclosed therein is adjustably mounted on the bow string by the archer at a position so that when the bow string is at its desired draw position, the kisser button contacts the archer's face. When the kisser button is properly positioned, it is secured to the bow string by, for example, serving or clamping the kisser button to the string. When the archer wishes to draw the bow string to the same desired position, he or she draws the bow string until the kisser button contacts the same location on his or her face. At this point, the bow string will be at the desired shooting position.

Prior art kisser buttons, such as disclosed in U.S. Pat. No. 4,539,970, typically included a slot connected to an aperture. To mount the kisser button, the strands of the bow string would be separated and inserted through the slot into the aperture. If the diameter of the aperture was smaller than the diameter of the bow string, the kisser button would not be able to accommodate the bow string. On the other hand, if the diameter of the kisser button was larger than the diameter of the bow string, the bow string would not remain centered in the aperture. It was therefore desirable that the aperture be the same size as the diameter of the bow string. This was impractical, however, because of the large number of commercially available bow strings having different diameters.

SUMMARY OF THE INVENTION

The present invention comprises an improved kisser button which accommodates bow strings having a range of diameters. The kisser button of the present invention, which is readily mountable and attachable to the bow string, comprises a thin, circular member having two or more radial slots, preferably located at equal angular distances from each other, through which strands of the bow string are inserted. The strands of the bow string are then secured to thin circular hub portions extending from both sides of the circular member.

Accordingly, it is an object of this invention to provide an improved kisser button which accommodates bow strings having a broad range of diameters.

Another object of this invention is to provide an improved kisser button which enables the kisser button to be centrally mounted with respect to bow strings having a broad range of diameters.

A still further object of the present invention is to provide an improved kisser button which may be readily secured to a bow string.

Other objects and attendant advantages of this invention will be readily appreciated as the same becomes better understood by references to the following detailed description when considered in connection with the accompanying drawings in which like reference numerals designate like pans throughout the figures thereof.

DETAILED DESCRITPION OF THE PREFERRED EMBODIMENT

Figure 1:
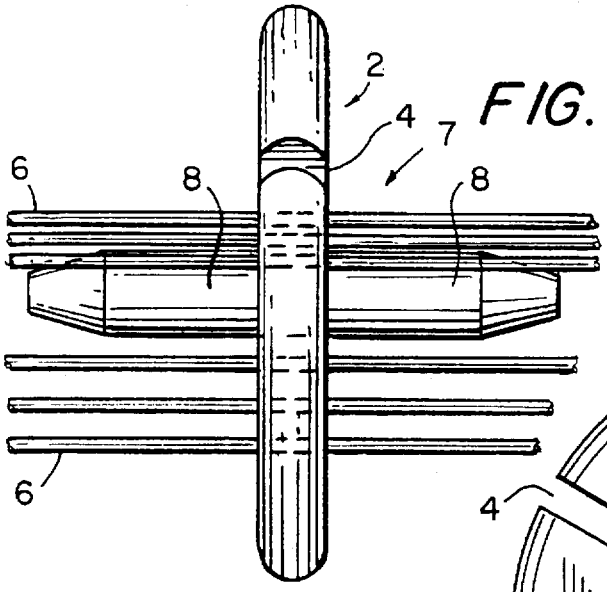
FIG. 1 is a side elevational view of the improved kisser button of the present invention and wherein the strands of a bow string are positioned within slots in the kisser button.
Figure 2:
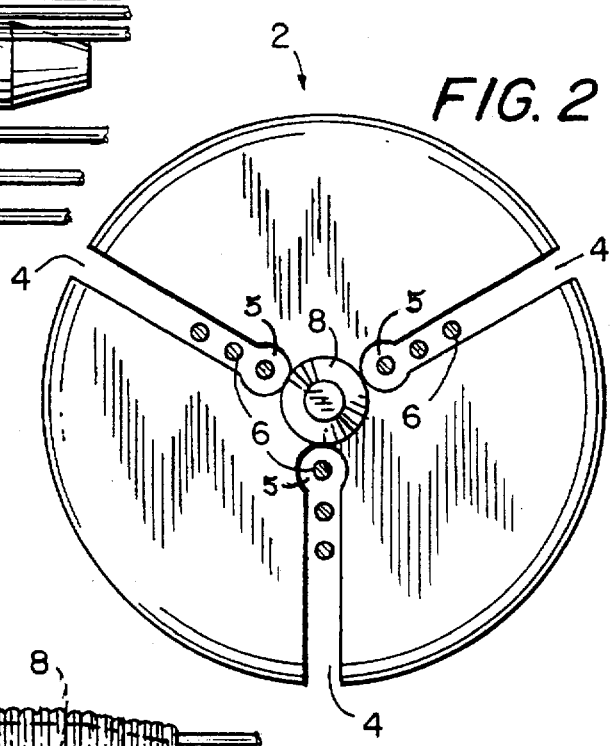
FIG. 2 is a front elevational view of the kisser button shown in FIG. 1.

In the illustrated embodiment of FIG. 1 and FIG. 2, a thin, circular kisser button 2, which may be formed of plastic material, has two or more radial slots 4 therein. Bow string strands, shown generally as 6, of a bow string 7 are inserted within the radial slots 4. It is preferable to include more than two such slots and for the slots to be located at equal angular distances from each other. It will be understood that the slots need only be large enough to accommodate a single bow string strand. Thin circular hub portions 8 extend from both sides of the kisser button. Thus, in contrast to prior art kisser buttons which have an opening in the center of the kisser button to accommodate the bow string, the present invention does not require any such opening.

Figure 3:
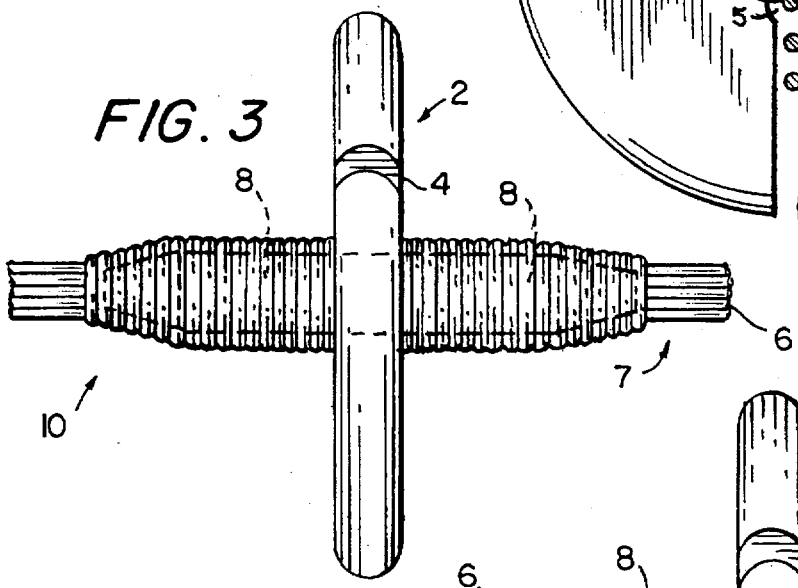
FIG. 3 is a side elevational view of the kisser button shown in FIG. 1 and wherein the kisser button and strands are attached by serving.
Figure 4:
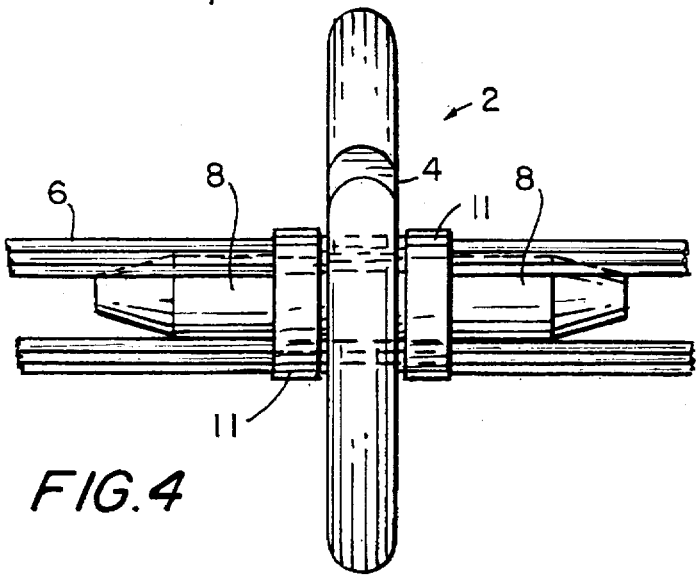
FIG. 4 is a side elevational view of the kisser button shown in FIG. 1 and wherein the kisser button and strands are attached by circumferential crimps.

To mount the kisser button 2 on the bow string 7, the archer separates the strands of the bow string 6 and inserts them in the radial slots 4. Radial slots 4 have a small circular portion 5 at the bottom thereof, the function of which is to accommodate a number of individual strands. It is preferable that there be the same number of strands 6 in each slot 4 and that each strand 6 be inserted in a slot 4 proximate thereto. After the strands 6 are inserted in the slots 4, the archer adjusts the kisser button 2 so that in the desired draw position, the kisser button 2 will contact the archer's face at a desired location. The kisser button 2 may then be secured to the bow string 7 by conventional serving (see FIG. 3) or other means such as circumferential crimps (see FIG. 4). Thereafter, when the archer wishes to draw the bow string to the same desired position, he or she draws the bow string until the kisser button contacts his or her face at a desired location, at which point the bow string will be in the proper shooting position.

From the foregoing, it will be seen that the improved bow string kisser button has many advantages including, but not limited to, being able to accommodate bow strings having a broad range of diameters, being centrally mountable with respect to bow strings having a broad range of diameters, and being readily mountable on the bow string.

While a preferred embodiment of my invention has been shown and described, it is to be understood that variations and changes may be resorted to without departing from the spirit of my invention as defined by the appended claims.

What I claim is:

1. An improved bow string kisser button for being positioned on a bow string to assist the archer in achieving a constant draw, said kisser button comprising at least two slots for receiving the strands of a bow string and at least one hub extending therefrom and wherein the length of the slots are substantially greater than the diameter of the hub.

2. An improved bow string kisser button as set forth in claim 1, wherein said slots are located at equal angular distances from each other.

3. An improved bow string kisser button as set forth in claim 1, wherein each such slot receives the same number of bow string strands.

4. An improved bow string kisser button as set forth in claim 1, wherein said kisser button is of circular shape and wherein said slots extend radially from a center hub of the kisser button.

5. An improved bow string kisser button as set forth in claim 1 wherein the strands of the bow string are attached to at least one such hub portion by serving.

6. An improved bow string kisser button as set forth in claim 1 wherein the strands of the bow string are attached to at least one such hub portion by a crimp device.

7. An improved bow string kisser button for being positioned on a bow string to assist the archer in achieving a constant draw location, said kisser button including at least one hub portion extending therefrom and comprising at least two slots for receiving the strands of a bow string and wherein the strands of the bow string are attached to at least one such hub portion by serving.

8. An improved bow string kisser button for being positioned on a bow string to assist the archer in achieving a constant draw location, said kisser button including at least one hub portion extending therefrom and comprising at least two slots for receiving the strands of a bow string and wherein the strands of the bow string are attached to at least one such hub portion by a crimp device.

9. An improved bow string kisser button for being positioned on a bow string to assist the archer in achieving a constant draw location, said kisser button including at least one hub portion extending therefrom and comprising at least two slots for receiving the strands of a bow string and wherein means are provided for attaching the strands of the bow string to at least one such hub portion by serving.

10. An improved bow string kisser button for being positioned on a bow string to assist the archer in achieving a constant draw location, said kisser button comprising at least two slots for receiving the strands of a bow string and including two solid hub portions extending therefrom.

11. An improved bow string kisser button as set forth in claim 10, wherein said slots are located at equal angular distances from each other.

12. An improved bow string kisser button as set forth in claim 10, wherein each such slot receives the same number of bow string strands.

13. An improved bow string kisser button as set forth in claim 10. wherein said kisser button is of circular shape and wherein said slots extend radially from the hub portions.

14. An improved bow string kisser button as set forth in claim 10 wherein the strands of the bow string are attached to at least one such hub portion by serving.

15. An improved bow string kisser button as set forth in claim 10 wherein the strands of the bow string are attached to at least one such hub portion by a crimp device.

16. An archery bow having an improved bow string kisser button for being positioned on a bow string to assist the archer in achieving a constant draw location, said kisser button comprising at least two slots for receiving the strands of a bow string and at least one hub extending therefrom and wherein the length of the slots are substantially greater than the diameter of the hub.

17. An archery bow having an improved bow string kisser button for being positioned on a bow string to assist the archer in achieving a constant draw location, said kisser button including at least one hub portion extending therefrom and comprising at least two slots for receiving the strands of a bow string and wherein means are provided for attaching the strands of the bow string to at least one such hub portion.

18. An archery bow having an improved bow string kisser button for being positioned on a bow string to assist the archer in achieving a constant draw location, said kisser button comprising at least two slots for receiving the strands of a bow string and including two solid hub portions extending therefrom.

* * * * *